US005470614A

United States Patent [19]

Chen et al.

[11] Patent Number: 5,470,614

[45] Date of Patent: Nov. 28, 1995

[54] TREATMENT OF WOOD AND OTHER LIGNOCELLULOSIC MATERIALS WITH IODATES

[75] Inventors: George C. Chen; Roger M. Rowell, both of Madison, Wis.

[73] Assignee: The United States of America as represented by the Secretary of Agriculture, Washington, D.C.

[21] Appl. No.: 418,909

[22] Filed: Apr. 6, 1995

Related U.S. Application Data

[63] Continuation of Ser. No. 205,008, Mar. 2, 1994, abandoned.

[51] Int. Cl.[6] ..... B05D 5/00; B05D 7/06

[52] U.S. Cl. ..... 427/440; 427/297; 427/317; 427/392; 427/393; 106/15.05; 424/668

[58] Field of Search ..... 427/317, 392, 427/393, 439, 440, 297; 106/15.05; 424/668

[56] References Cited

U.S. PATENT DOCUMENTS

| | | | |
|---|---|---|---|
| 3,775,047 | 11/1973 | Weston | 8/37 |
| 3,985,921 | 10/1976 | Rowell et al. | 427/317 |
| 4,329,383 | 5/1982 | Joh | 428/36 |
| 4,780,341 | 10/1988 | Chow | 427/440 |
| 4,804,384 | 2/1989 | Rowell et al. | 8/121 |

OTHER PUBLICATIONS

Chen, G. and Rowell, R. Fungal and Termite Resistance of Wood Reacted with Periodic Acid or Sodium Periodate, Wood & Fiber Science 21(2) 1989 pp. 164–168.

*Primary Examiner*—Shrive Beck
*Assistant Examiner*—Brian K. Talbot
*Attorney, Agent, or Firm*—Janet I. Stockhausen; M. Howard Silverstein; John D. Fado

[57] ABSTRACT

This invention is a method for the protection of wood and other lignocellulosic materials from attack by micro-organisms with the use of iodates. The method consists of treating wood or other lignocellulosic material by soaking it in a solution of iodate for a period of time ranging from three hours to seven days at temperatures between 20° C. and 50° C. The treated material is then removed from the solution and dried. Wood treated with this method shows resistance to attack by wood-degrading micro-organisms. Furthermore, the iodates are resistant to leaching from the wood and other lignocellulosic materials after such treatment.

9 Claims, No Drawings

TREATMENT OF WOOD AND OTHER LIGNOCELLULOSIC MATERIALS WITH IODATES

This is a continuation of application Ser. No. 08/205,008, filed Mar. 2, 1994 now abandoned.

FIELD OF THE INVENTION

The present invention relates to the field of the chemical treatment of lignocellulosic materials. More specifically, the invention involves a method of treating lignocellulosic materials with iodate salts to prevent or control contamination and degradation of such material by micro-organisms. The class of lignocellulosic materials covered by this invention includes but is not limited to wood, wood products, bamboo, flax, and kenaf.

DESCRIPTION OF THE PRIOR ART

The search for methods of treating lignocellulosic materials which provide optimal protection from biological degradation dates back to the time of the ancient Egyptians and beyond. Unfortunately, those chemicals with the best preservative properties often pose the greatest threats to the environment.

Many different water soluble salts have been noted for superior wood preservative properties, such as borax, chromium salts, zinc chlorides, mercuric chloride, nickel salts, sodium fluoride, and sodium fluosilicate (Hunt & Garratt, *Wood Preservation,* 3rd ed., pp. 112–115). Such salts offer the advantages of high effectiveness against both fungi and insect infestation, ease of handling (due to the ability to transport in solid form), and superior properties of treated wood in terms of later treatment with paints or fire retardants.

Unfortunately, treatment of wood with such water soluble inorganic salts has some disadvantages. Most such salts which have been utilized as wood preservatives leach out of wood over time. Consequently, such salt-treated wood becomes susceptible to biological attack as the concentration of salt remaining in the wood decreases. Also, as the salt leaches out of the wood, it contaminates the surrounding environment, where it can threaten the viability of other organisms. Chromium salts are relatively resistant to leaching because the salts form complexes with extractives and polymers in the wood. Unfortunately, chromium salts are also highly toxic.

Unlike aqueous salts, organic chemicals do not tend to leach out of treated lumber to a significant extent over time, nor are the chemicals corrosive. However, organic wood preservatives present other problems. Like their inorganic counterparts, organic chemical preservatives, such as pentachlorophenol or creosotes, are effective as biocides preventing infestation by wood-degrading micro-organisms and insects. But such organic chemicals are highly toxic and they are generally not odorless. Wood treated with traditional organic chemical preservatives is more flammable than untreated wood and it binds poorly to waterborne paints and adhesives. Also, the same properties which make organic chemicals seemingly ideal preservatives also make disposal of wood treated with such preservatives difficult.

Most chemicals in use today for wood preservation, whether aqueous or organic, are highly toxic to a broad spectra of micro-organisms. Wood treated with these traditional chemicals, such as chromated copper arsenates or creosote, pose a serious threat to the environment through either leaching or the need for later disposal. An alternative preservative is needed which is not highly toxic to higher organisms, which does not leach out of impregnated wood or other lignocellulosic materials significantly over time, yet effectively protects these materials from degradation by micro-organisms such as fungi.

The biocidal properties of iodates, defined in the instant application as $IO_3^-$, hereinafter referred to as iodates, have been well documented, even if their mechanism of action is poorly understood. Iodates have been used to sterilize water (Australia Patent 464,315 (C1C02B)). It has also been reported by Miller et. al. in *Physiol. Plant.*, vol. 34 (1975) pp. 153–156 that iodates reduce respiration and oxidative phosphorylation in corn mitochondria.

Both iodate and periodate salts have been found useful in pulp processing, but in different capacities. Iodates have been used as stabilizers in oxidative pulping processes (Minor and Bormett, *TAPPI*, vol. 60 (1977) pp. 130–132). Periodates have been used to oxidize sulphate pulped wood (Nedeltschewa et.al., *Papier*, vol. 31 (1977) pp. 106–9).

Chen and Rowell (*Wood and Fiber and Science*, vol. 21 (1989) pp.163–168) have found that periodic acid and sodium periodate are effective wood preservatives. However there is no evidence in the prior art that iodates, such as sodium or potassium iodate, have ever been used for preservation of any type of lignocellulosic material.

SUMMARY OF THE INVENTION

The present invention is a method for protecting wood and other lignocellulosic materials from biological degradation by impregnation with iodates. Materials treated with this method show the retention of iodates after water leaching.

The treatment method consists of the soaking wood or other lignocellulosic material in an iodate solution at temperatures ranging from 20° to 50° C. The treated material is then removed from the iodate solution and allowed to dry.

Impregnation of iodates into the wood and other lignocellulosic materials can be accomplished by use of either an organic or aqueous carrier solution. In a preferred embodiment, said iodate solution is an aqueous solution, and said iodate is potassium or sodium iodate.

The soaking of wood and other lignocellulosic material can be done at standard pressure, by use of vacuum-pressure, pressure or other standard wood preservation processes. Use of vacuum-pressure or pressure techniques at this step reduces treatment time and increases the level of penetration of the iodate solution into the material, thereby increasing the effectiveness of the preservative.

Wood treated with this method shows good resistance to attack by wood-degrading micro-organisms, and high resistance to leaching of iodates from the wood over time. A standard soil block test ASTM D1413-76 (1986) is used to demonstrate the effectiveness of this treatment.

For purposes of illustration only, a detailed description of the preferred embodiments of this invention follows.

DETAILED DESCRIPTION

The present invention is a simple, safe, and relatively inexpensive method of wood and other lignocellulosics preservation. Practical performance of the treatment can be varied within the limits described below.

Wood to be treated with this method can have a moisture content varying from dry to green, i.e. moisture content ranging from less than 20% to greater than 100%. Impregnation of the iodate solution is more effective when done on dry wood, preferably with a moisture content of less than 20%. However, it is not essential to the process that the wood be dried before treatment. The moisture content of other lignocellulosic material is not a critical factor in treatment with iodates.

The wood or other lignocellulosic material is soaked in a solution containing an iodate salt, such as potassium or sodium iodate. For aqueous salt solutions, the concentration of iodates in water can range from 0.1% to chemical saturation. Choice of iodate concentration to be used may depend on a variety of factors including the species, size, type, form and other characteristics of the wood or lignocellulosic material to be treated as well as intended end use of the treated material.

The wood or other lignocellulosic material is preferably soaked under conditions which ensure complete penetration by the iodate through the entire material body. The amount of time the lignocellulosic material is permitted to soak is determined by the dimensions, dryness, and type of lignocellulosic material to be treated. In the case of treatment with an aqueous solution of iodates, the preferred length of time is one to seven days. Other impregnation techniques may be used at the soaking step to increase the penetration of iodates into the material and at the same time, decrease the time needed to achieve maximum penetration. Treatment time may be 3 to 6 hours when employing these other techniques. Some of the known techniques include full cell and empty cell pressure impregnation and vacuum soaking. Pressure and vacuum-pressure techniques are often preferred for wood, especially for pieces with large cross-sections. These vacuum-pressure and other impregnation techniques may be used for treatment of other lignocellulosic materials, but may not be essential in order to achieve maximum penetration.

The temperature of the treatment solution can be between 20° and 50° C. Treatment at higher temperatures promotes diffusion of the iodate into the lignocelluosic material. However, temperatures at 55° C. or above results in decomposition of wood.

After soaking, the wood or other lignocellulosic material is removed from the iodate solution and dried. A vacuum may be applied to the treated material in order to remove the excess treatment solution. The treated material is then removed and may be dried at room temperature and atmospheric pressure. Alternatively, a vacuum is not applied, and the treated material may be dried to the desired moisture content at room temperature and atmospheric pressure. Another option would be kiln drying the treated material.

The following examples are presented as further illustration of this method. The examples below are included solely for the purpose of illustration and description only, and are not intended to define limitations on the expression of this invention.

Wood blocks (1.9 $cm^3$ in size) tested were selected according to the American Society for Testing and Materials Standards (ASTM) D 1413-76 (1986). For Examples 1 and 2, six different concentrations of aqueous solutions of potassium iodate used were as follows: 1%, 0.5%, 0.1%, 0.05%, 0.025% and 0.01% (weight/weight). Soil-block fungal decay tests and leaching tests were run according to ASTM standards outlined in D 1413-76 (1986). Wood blocks treated in Examples 3 and 4 were treated with concentrations of 0.01%, 0.1% and 1% (weight/weight) of aqueous solutions of sodium iodate.

Kenaf samples in Examples 5 and 6 were treated with concentrations of 0.1%, 0.5% and 1% (weight/weight) of aqueous iodate solutions. Samples in Example 5 were treated with potassium iodate solutions, and those in Example 6 with sodium iodate solutions.

A. Treatment Examples

EXAMPLE 1

Loblolly Pine

Wood blocks of loblolly pine 1.9 $cm^3$ in size were placed in a desiccator and dried under vacuum at 17 to 25 mm mercury for 1 hour. These blocks were then allowed to soak in an aqueous solution of potassium iodate for 24 hours at room temperature and atmospheric pressure. Six different concentrations (1%, 0.5%, 0.1%, 0.05%, 0.025% and 0.01% (weight/weight)) of potassium iodate solution were used to determine the minimum amount of salt needed to effectively protect the wood. After soaking, the blocks were removed from the treatment solutions and air-dried.

EXAMPLE 2

Sweetgum Sapwood

Wood blocks of sweetgum sapwood 1.9 $cm^3$ in size were placed in a desiccator and dried under vacuum at 17 to 25 mm mercury for 1 hour. These blocks were then allowed to soak in an aqueous solution of potassium iodate for 24 hours at room temperature and atmospheric pressure. Six different concentrations (1%, 0.5% 0.1%, 0.05%, 0.025% and 0.01% (weight/weight)) of potassium iodate solution were used as described above to determine the minimum amount of salt needed to effectively protect the wood. After soaking, the blocks were removed from the treatment solutions and air-dried.

EXAMPLE 3

Loblolly Pine

Wood blocks of loblolly pine 1.9 $cm^3$ in size were placed in a desiccator and dried under vacuum at 17 to 25 mm mercury for 1 hour. These blocks were then allowed to soak in an aqueous solution of sodium iodate for 24 hours at room temperature and atmospheric pressure Three different concentrations ( 0.01%, 0.1% and 1.0%) of sodium iodate solution were used. After soaking, the blocks were removed from the treatment solutions and air-dried.

EXAMPLE 4

Sweetgum Sapwood

Wood blocks of sweetgum sapwood 1.9 $cm^3$ in size were placed in a desiccator and dried under vacuum at 17 to 25 mm mercury for 1 hour. These blocks were then allowed to soak in an aqueous solution of sodium iodate for 24 hours at room temperature and atmospheric pressure. Three different concentrations (0.01%, 0.1% and 1.0%) of sodium iodate solution were used. After soaking, the blocks were removed from the treatment solutions and air-dried.

EXAMPLE 5

Kenaf

Kenaf samples, 1 gram each, were dried at 30° C. for one day. The kenaf samples were then placed in a desiccator and dried under vacuum at 17 to 25 mm mercury for 1 hour. The kenaf samples were then allowed to soak in an aqueous solution of potassium iodate for 24 hours at room temperature and atmospheric pressure. The three concentrations of solution used were 1%, 0.5% and 0.1%. After soaking, the kenaf samples were removed from the treatment solutions and air-dried.

EXAMPLE 6

Kenaf

Kenaf samples, 1 gram each, were dried at 30° C. for one day. The kenaf samples were then placed in a desiccator and dried under vacuum at 17 to 25 mm mercury for 1 hour. The kenaf samples were then allowed to soak in an aqueous solution of sodium iodate for 24 hours at room temperature and atmospheric pressure. The three concentrations of solution used were 1%, 0.5% and 0.1%. After soaking, the kenaf samples were removed from the treatment solutions and air-dried.

B. Leaching Test Results

Blocks from Examples 1 and 2 above which were treated at iodate concentrations of 0.01%, 0.1%, and 1.0% respectively were tested for salt leaching as described in ASTM D 1413-76 (1986). Seven blocks per treatment were conditioned at 27° C. and 30% relative humidity (RH) for 3 weeks, while another seven blocks per treatment were leached in 350 ml of distilled water each day for 2 weeks. The leached blocks were likewise conditioned at 27° C. and 30% RH for 3 weeks after leaching.

The results of this assay are given in Table I.

TABLE I

| Solution concentration (%) | Iodate content in wood before leaching[1] Weight (%, w/w) | Iodate content in wood before leaching[1] Molar content (mmoles/100 g wood) | Iodate content in wood after leaching[1] Weight (%, w/w) | Iodate content in wood after leaching[1] Molar content (mmoles/100 g wood) | Molar percent of potassium iodate in wood before and after water leaching (%) |
|---|---|---|---|---|---|
| Loblolly Pine: | | | | | |
| 0.01 | 0.01 | 0.08 | 0.006 | 0.048 | 60 |
| 0.1 | 0.10 | 0.80 | 0.074 | 0.58 | 73 |
| 1.0 | 1.08 | 8.51 | 0.41 | 3.23 | 38 |
| Sweetgum: | | | | | |
| 0.01 | 0.01 | 0.08 | 0.0053 | 0.042 | 53 |
| 0.1 | 0.11 | 0.87 | 0.036 | 0.28 | 32 |
| 1.0 | 1.12 | 8.83 | 0.23 | 1.81 | 21 |
| Control | <0.0002 | | | | |

Blocks from Examples 3 and 4 above which were treated at sodium iodate concentrations of 0.01%, 0.1%, and 1.0% respectively were tested for salt leaching as described in ASTM D 1413-76 (1986). Seven blocks per treatment were conditioned at 27° C. and 30% RH for 3 weeks, while another seven blocks per treatment were leached in 350 ml of distilled water each day for 2 weeks. The leached blocks were likewise conditioned at 27° C. and 30% RH for 3 weeks after leaching. The results of this assay are given in Table II.

TABLE II

| Solution concentration (%) | Iodate content in wood before leaching[1] Weight (%, w/w) | Iodate content in wood before leaching[1] Molar content (mmoles/100 g wood) | Iodate content in wood after leaching[1] Weight (%, w/w) | Iodate content in wood after leaching[1] Molar content (mmoles/100 g wood) | Molar percent of sodium iodate in wood before and after water leaching (%) |
|---|---|---|---|---|---|
| Loblolly Pine: | | | | | |
| 0.01 | 0.01 | 0.05 | 0.048 | 0.02 | 40 |
| 0.1 | 0.10 | 0.51 | 0.18 | 0.9 | 180 |
| 1.0 | 1.09 | 5.51 | 0.25 | 1.3 | 20 |
| Sweetgum: | | | | | |
| 0.01 | 0.01 | 0.05 | 0.043 | 0.02 | 40 |
| 0.1 | 0.11 | 0.56 | 0.11 | 0.6 | 110 |
| 1.0 | 1.06 | 5.36 | 0.16 | .8 | 10 |
| Control | <0.0002 | | | | |

[1]Chemically analyzed by the Galbreath Laboratories, Inc.

Treated kenaf samples (1 gram each) from Examples 5 and 6 were leached in 100 ml of distilled water daily for two weeks. After leaching, the leached and unleached samples were heated at 30° C. for 24 hours and weighed. The results of this assay are given in Table III.

TABLE III

| Solution concentration (%) | Iodate content in kenaf before leaching[1] Weight (%, w/w) | Iodate content in kenaf before leaching[1] Molar content (mmoles/100 g kenaf) | Iodate content in kenaf after leaching[1] Weight (%, w/w) | Iodate content in kenaf after leaching[1] Molar content (mmoles/100 kenaf) | Molar percent of sodium or potassium iodate in kenaf before and after water leaching (%) |
|---|---|---|---|---|---|
| Potassium: Iodate: | | | | | |
| 0.1 | 0.44 | 0.02 | 0.01 | 0.047 | 235 |
| 0.5 | 2.50 | 0.12 | 0.026 | 0.012 | 10 |
| 1.0 | 5.45 | .25 | 0.034 | .016 | 6 |
| Sodium Iodate: | | | | | |
| 0.1 | 0.58 | 0.03 | 0.015 | 0.076 | 250 |
| 0.5 | 2.95 | 0.15 | 0.030 | 0.015 | 10 |
| 1.0 | 5.90 | 0.30 | 0.040 | 0.020 | 7 |
| Control | <0.0005 | | | | |

[1]Chemically analyzed by Galbreath Laboratories, Inc.

C. Soil-Block Test Results

Wood blocks treated with potassium iodate as described in Examples 1 and 2 were tested for resistance to degradation by wood-degrading fungi using standard soil-block assays. Tests were run according to specifications of the ASTM as outlined in D 1413-76 (1986). The brown-rot fungus, *Gloeophyllum trabeum*, was used with loblolly pine blocks (from Example 1). The white-rot fungus species, *Coriolus versicolor*, was used with sweetgum blocks (from Example 2).

Five replicate blocks from each treatment were leached daily with 350 ml distilled water for a period of two weeks. After leaching, the blocks were conditioned at 27° C. and 30% RH for three weeks. The leached blocks along with five replicate blocks from each treatment and five control blocks were tested for decay resistance over a period of 12 weeks. The extent of fungal attack was determined by weight loss. Solution retention concentration that resulted in weight loss by decay of equal to or less than 2% was generally considered as the threshold retention. Threshold retention is defined as being the lowest level of chemical treatment that can be used to give the desired effect. The results of this assay are given in Table IV.

TABLE IV

| Solution concentration (%) | Retention (%, w/w)[1] Loblolly pine | Sweetgum | Weight loss (%)[2] *G. trabeum* Unleached | Leached | C. versicolor Unleached | Leached |
|---|---|---|---|---|---|---|
| 1.0 | 1.35(1.35)[3] | 1.58(1.58)[3] | 1.0 | 1.2 | 0.9 | 0.2 |
| 0.5 | 0.67(0.67) | 0.77(0.77) | 1.7 | 7.3 | 0.7 | 0.5 |
| 0.1 | 0.13(0.13) | 0.15(0.15) | 24.2 | 39.6 | 1.0 | 0.5 |
| 0.05 | 0.06(0.06) | 0.08(0.08) | 43.5 | 54.0 | 4.9 | 8.6 |
| 0.025 | 0.03(0.03) | 0.04(0.04) | 49.7 | 52.2 | 21.1 | 21.7 |
| 0.01 | 0.01(0.01) | 0.02(0.02) | 58.4 | 52.9 | 30.9 | 38.8 |
| Control | N/A | N/A | 61.9 | — | 44.1 | — |

[1]Percent iodate in wood (w/w) before leaching; mean of 10 replicates including five unleached and five leached blocks
[2]Mean of five replicates
[3]Parentheses are pound of iodate per cubic feet of wood (pcf)

Soaking the blocks in low concentrations of potassium iodate solutions for one day was effective in resisting decay by brown- and white-rot fungi, even after 2 weeks of water leaching. Threshold retention with *G. trabeum* were 0.5% and 1% (w/w) for unleached and leached blocks, respectively. Threshold retention with *C. versicolor* was 0.1% for both unleached and leached blocks.

We claim:

1. A method of treating lignocellulosic material which comprises the following steps:

a. soaking of said lignocellulosic material with an $IO_3^-$ solution;

b. removal of said lignocellulosic material from said $IO_3^-$ solution; and c. drying said lignocellulosic material, wherein the material is resistant to fungi.

2. The method of claim 1 wherein said lignocellulosic material is selected from the group consisting of wood, bamboo, flax, and kenaf.

3. The method of claim 1 wherein said iodate solution is an aqueous solution.

4. The method of claim 1 wherein said iodate solution is an organic solution.

5. The method of claim 1 wherein said iodate solution comprises potassium iodate.

6. The method of claim 1 wherein said iodate solution comprises sodium iodate.

7. The method of claim 1 wherein said lignocellulosic material is soaked for between about 3 hours and 7 days.

8. The method of claim 1 wherein the temperature of said iodate solution is between about 20° C. and 50° C.

9. The method of claim 1 additionally comprising the step of exposing the lignocellulosic material to a vacuum after step b and before step c.

* * * * *